US005244607A

United States Patent [19]

Rheutan, Jr. et al.

[11] Patent Number: 5,244,607

[45] Date of Patent: Sep. 14, 1993

[54] QUENCHING AND COAGULATION OF FILAMENTS IN AN ULTRASONIC FIELD

[75] Inventors: Richard D. Rheutan, Jr., Richmond, Va.; Harold F. Staunton, Avondale, Pa.; Christopher R. Whitfield, Richmond, Va.

[73] Assignee: E. I. Du Pont de Nemours and Company, Wilmington, Del.

[21] Appl. No.: 919,141

[22] Filed: Jul. 23, 1992

[51] Int. Cl.[5] ..... B06B 3/00; D01D 5/06; D01D 10/06; D01D 11/00

[52] U.S. Cl. ..... 264/23; 264/85; 264/180; 264/210.8; 264/211.14; 264/233

[58] Field of Search ..... 264/23, 85, 180, 210.8, 264/211.14, 233

[56] References Cited

U.S. PATENT DOCUMENTS

| | | | |
|---|---|---|---|
| 2,484,012 | 10/1949 | Calhoun, Jr. | 264/23 |
| 2,484,014 | 10/1949 | Peterson et al. | 264/23 |
| 2,558,037 | 6/1951 | Calhoun, Jr. et al. | 536/61 |
| 2,717,768 | 9/1955 | Carpenter | 366/114 |
| 2,954,271 | 9/1960 | Cenzato | 264/23 |
| 3,493,422 | 2/1970 | Berry, Jr. | 427/371 |
| 4,071,225 | 1/1978 | Holl | 366/114 |
| 4,391,672 | 7/1983 | Lehtinen | 162/192 |
| 4,556,467 | 12/1985 | Kuhn et al. | 204/193 |

FOREIGN PATENT DOCUMENTS

| | | | |
|---|---|---|---|
| 46-33404 | 9/1971 | Japan | 264/23 |

OTHER PUBLICATIONS

English Translation of Japan 62-141,111 (published Jun. 24, 1987).

English Translation of Japan 2-127,506 (published May 16, 1990).

*Primary Examiner*—Leo B. Tentoni

[57] ABSTRACT

More uniform and more rapid quenching and coagulation of filaments is achieved by contacting the filaments in a chamber with coagulating liquid and generating pressure fluctuations in the liquid at high frequency sonic or ultrasonic frequencies.

6 Claims, 2 Drawing Sheets

QUENCHING AND COAGULATION OF FILAMENTS IN AN ULTRASONIC FIELD

BACKGROUND OF THE INVENTION

A process for preparing m-phenylene isophthalamide fiber involves spinning the solution of the polymer, as prepared, including dimethylacetamide and by-product calcium chloride and contacting the extruded filaments with a hot inert gas such as nitrogen to partially remove solvent. A cold aqueous solution is used to quench and coagulate the filaments. Finally, the filaments are wash-drawn and collected. Satisfactory results have been achieved by this process, however, attempts to increase throughput in the quench-coagulation step has often resulted in nonuniformities as shown by opaque white streaks in the otherwise translucent filaments and by variations in tensile strength among the filaments. Also, fusion between filaments may occur as well because of slow, non-uniform cooling of some filaments. The present invention has applicability to processes wherein the freshly extruded solvent-containing filaments first contact an inert gas or fluid before quench-coagulation with an aqueous solution as well as to wet-spinnning processes wherein the solvent-containing filaments are spun directly into an aqueous quench-coagulation solution.

DRAWINGS

FIG. 1 depicts a fiber manufacturing process under consideration in this invention. In Step 1, the polymer solution is extruded into filaments. In Step 2, the filaments are optionally contacted with a flow of hot inert gas to drive off part of the solvent. In Step 3, the filaments are contacted with a liquid which quenches and coagulates the filaments. In Step 4, the filaments are wash-drawn and in Step 5 the filaments are collected.

FIG. 2 is a schematic side view of the chamber in which quench-coagulation takes place.

SUMMARY OF THE INVENTION

The present invention provides an improved process for preparing fiber from a polymer solution which includes the steps of:

a) extruding the solution from a spinneret to form a plurality of filaments;

b) optionally passing the extruded filaments through an inert gas;

c) treating the filaments with an aqueous liquid coagulant to quench and coagulate the filaments;

d) washing and drawing the filaments; and e) collecting the filaments; the improvement comprising, quench coagulating the filaments more uniformly and more rapidly in step c) by passing the filaments between substantially parallel opposing walls of a chamber containing the aqueous liquid coagulant, the said opposing walls comprising the faces of ultrasonic transducers, and driving the transducers, in phase, at a frequency of from 5 to 100 kHz to cause pressure fluctuations in the liquid coagulant, the spacing between the said opposing walls being less than one-half the wavelength of sound generated by the transducers in the liquid coagulant.

DETAILED DESCRIPTION OF THE INVENTION

The present invention is described below with reference to a process for preparing m-phenylene isophthalamide (MPDI) fiber. However, the invention can be applied to other processes such as the spinning process described in the Blades patent U.S. Pat. No. 3,767,756 for making poly(p-phenylene terephthalamide) fiber wherein the solvent-containing filaments leaving the spinneret are first passed through an air gap and then through aqueous liquid coagulant or a spinning process wherein the solvent-containing filaments leaving the spinneret are passed directly into and through an aqueous liquid coagulant. The process is particularly effective in the production of aromatic polyamide fiber, preferably aramid fiber where a salt is present in the spin dope. Conventional quench coagulation is adversely affected by the presence of salts in the spin dope, as will be understood to those skilled in the art.

As-prepared MPDI polymer solution conventionally contains dimethyl acetamide (DMAc) or other solvent and calcium chloride or other salt in addition to the polymer itself. The solvent may constitute as much as about 80% of the solution. In the process for preparing fiber from the polymer, this solution or spin dope is spun or extruded through a spinneret to form a plurality of filamentary streams, and a flow of hot inert gas such as nitrogen at a temperature of about 450° C. is passed in contact with the spun filaments. The solvent content of the filaments is thereby reduced. In the next step of the process, the hot filaments are contacted with an aqueous liquid, generally cold water, below 5° C., which quenches and coagulates the filaments. It is this step which is the focus of the present invention. Streaks are the result of improper quenching, that is, the quench liquid is not uniformly distributed around the filaments when they contact the quench liquid. Uniform quenching produces a uniform, polymer-rich skin structure on the surface of the fiber. Improper quenching allows water to penetrate the skin structure and create voids in the surface.

Figure 1:
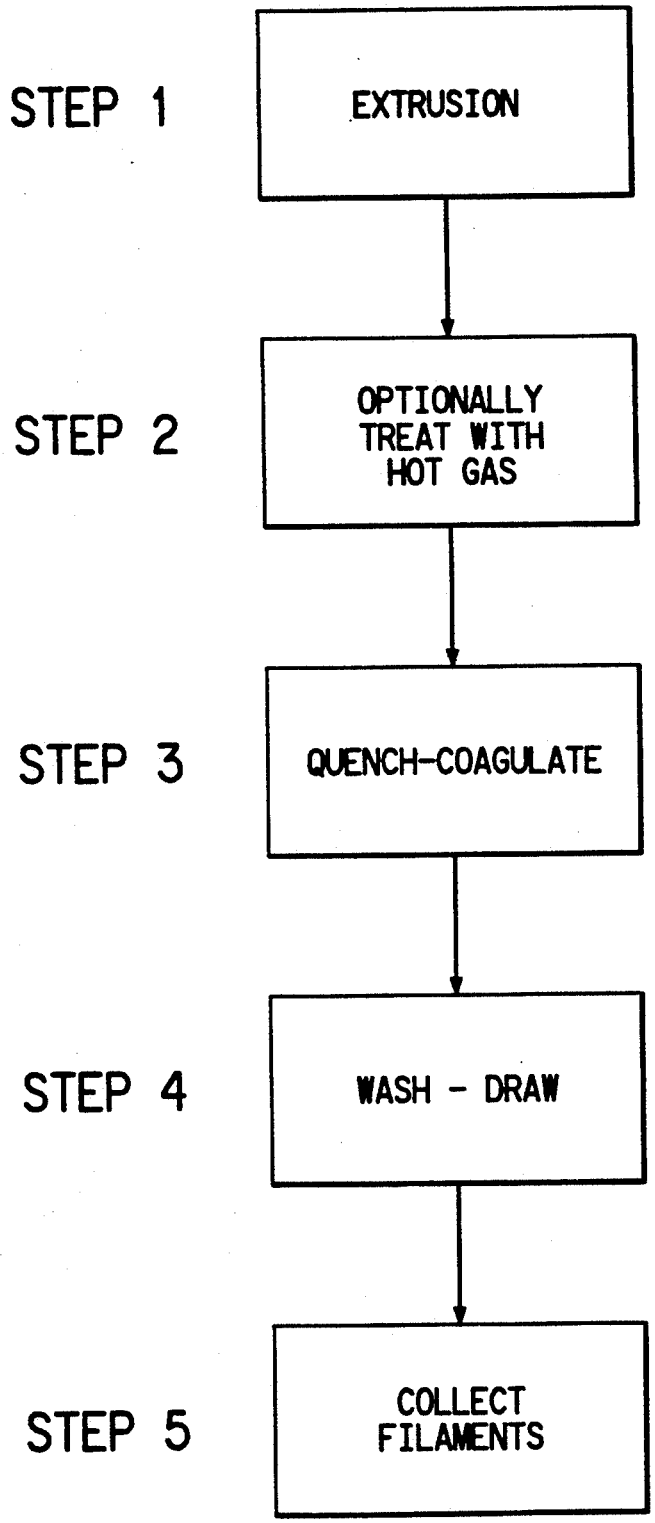
Figure 2:
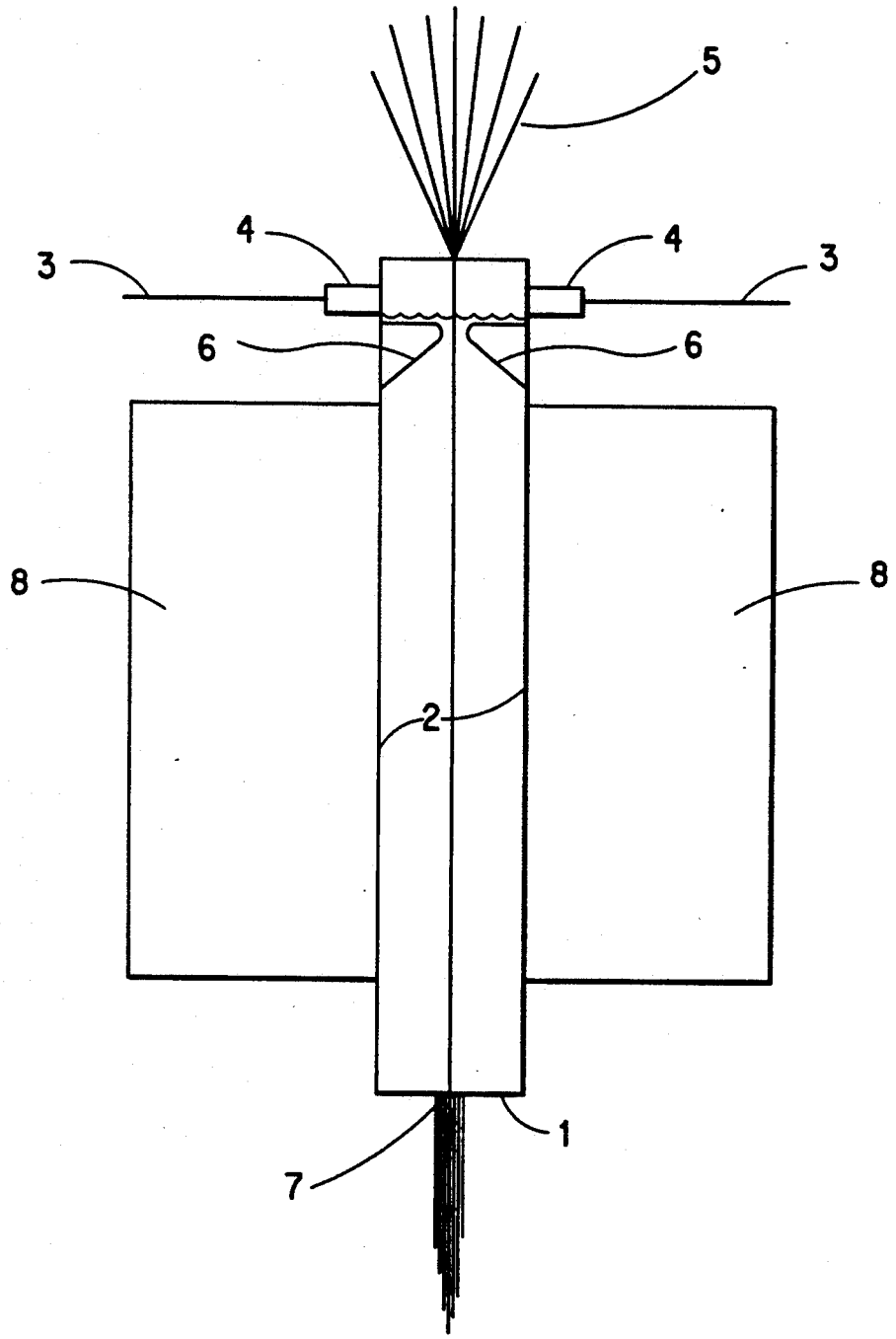

To achieve the improvement of the present process, the filaments are quench-coagulated in a special manner. The filaments, after treatment with the hot inert gas, are passed through a chamber having opposing walls comprising radiating ultrasonic transducer faces. The filaments in bundles of 15,000 denier or greater may traverse the length of the chamber at speeds of 200 to 250 yards per min. or even faster. Cold liquid is fed into the chamber generally at a rate of 80 to 120 gallons per hour, to quench and coagulate the filaments. The procedure can be performed as depicted in FIG. 2 showing a schematic side view of the chamber 1, having opposing walls 2. Aqueous liquid coagulant 3 enters through ports 4 to maintain a desired level in the chamber. Filaments 5 enter the chamber, are centered and flattened into a ribbon by guide 6 and pass through the chamber in contact with coagulant liquid 3. The opposing faces 2 of ultrasonic transducers 8 are driven, in phase, at a frequency of from 5–100 kilohertz kHz. By "in phase" is meant that the two opposing transducer faces move towards and away from each other in synchronism. Magnetostrictive or piezoelectric devices may be employed as the transducers. Preferably, a frequency of from 20 to 70 kHz is employed. Vibra-Bar transducers (Crest Ultrasonics, Trenton, N.J.) at 40 or 65 kHz are suitable for this purpose. The distance between the two opposing walls of the chamber which are constituted by the radiating transducer faces should be less than one-half the wavelength of the sound generated by the transducers in the liquid coagulant. Generally, 1 inch or less is suitable, the specific distance limit being readily determined by the frequency at which the transducers are driven and the coagulant fluid employed, as is well-understood by the art. For example, at a frequency of 40 kHz with water as coagulant at 4° C. the faces are about ¾ inch apart or less.

The transducers used in this invention are driven at a total average power level of 36 to 250 watts to provide average power densities of approximately 1 to 7 watts per square inch of radiating area and 4 to 28 watts per cubic inch of liquid in the quench chamber. When compared to conventional ultrasonic cleaning baths, the maximum area power density of this invention is 2 to 3 times higher, while the maximum volume power density is 100 to 600 times higher.

The intense sound field generated by the transducers is characterized by pressure fluctuations in the quench liquid that are most intense in the plane centered between the radiating transducer faces, which is congruent with the path of the ribbon of filaments. The pressure fluctuations produce several beneficial effects that improve the uniformity and speed of filament quenching or coagulation. On a macroscopic scale, the quench liquid is driven into and out of the filament ribbon to improve the uniformity of the liquid contact with all of the filaments, particularly those not in the surface layer of the ribbon. On a microscopic scale, localized, high-velocity liquid eddies and currents penetrate the filament boundary layers to continually carry fresh quench liquid to the filament surfaces. Also, cavitation bubbles form and collapse as the sound pressure field alternates below and above the ambient pressure, creating extremely localized shock waves. These microscopic phenomena combine to increase thermal diffusion and mass transfer rates, thereby increasing the speed of the quench-coagulation process.

The treated fiber bundle and entrained liquid exits the chamber through port 7. The quenched-coagulated MPD-I filaments are normally subjected to a wash-draw where the filaments are washed and drawn and then collected before or after drying.

The following example of the invention is not intended as limiting.

EXAMPLES

The fibers or filaments of these examples were prepared from aromatic polymers such as are disclosed in U.S. Pat. No. 3,063,966 to Kwolek, Morgan, and Sorenson; 3,094,511 to Hill, Kwolek and Sweeny; and 3,287,324 to Sweeny, for example. Filaments were prepared from a filtered solution consisting of 19.2%, based on the weight of the solution, of poly(meta-phenylene isophthalamide) in N,N-dimethylacetamide (DMAc) that contains 45% calcium chloride based on the weight of the polymer. The polymer had an inherent viscosity of 1.57 as measured on a 0.55 solution in DMAc/4% LiCl at 25 degrees C. The spinning solution was heated to 120–145 degrees C and extruded through a 3600-hole spinneret, each hole 0.006 inch (150 microns) in diameter and 0.012 inch (300 microns) long, into heated spinning cells containing an inert gas. For each of the following examples, the speed of the just-spun filaments was in excess of 200 ypm.

EXAMPLE 1 (CONTROL)

This example illustrates a prior art process, which is disclosed in U.S. Pat. No. 3,493,422 to Berry; this reference discloses an apparatus and process for efficient heat and/or mass transfer by sequentially contacting a moving shaped structure through a stripping liquid. The filaments, as spun above, (each filament being about 12 dpf as spun), were formed into a flat ribbon of filaments at the top of the quench zone and then brought in contact with a cold, approximately 4° C., aqueous solution containing 4–12% DMAc and flowing essentially co-current with the filament ribbon in a serpentine manner as dictated by the shape of the quenching apparatus. Filaments made by this process had visible streaks, the quantity of which was proportional to the speed of the filament ribbon.

EXAMPLE 2

This example illustrates the invention of this application. The filaments, as spun above (each filament being about 12 dpf as spun), were formed into a flat ribbon at the top of the quench zone and then entered a straight rectangular quench chamber approximately 1 in. by 3 in. in cross-section and 6 in. long, said chamber containing a cold, approximately 4 degrees C, aqueous solution containing 4–12% DMAc and flowing co-current with the filament ribbon. The radiating faces of two piezoelectric transducers constituted the opposing wider walls of the chamber as illustrated in FIG. 2. The width of the ribbon passed between the two opposing transducer faces which were vibrated in phase (moving towards and away from each other in synchronism) at a sonic frequency of 40 kHz, generating intense pressure fluctuations in the liquid in the sonic field zone. The two transducers were driven at a total average power level of 250 watts to provide average power densities of approximately 7 watts per square inch of radiating surface area and 28 watts per cubic inch of liquid in the quench zone. Essentially none of the filaments made by this process had visible streaks; and filament quality was not as sensitive to the speed of the filament ribbon.

We claim:

1. In a process for preparing fiber from a polymer solution which includes the steps of:
   a) extruding the solution from a spinneret to form a plurality of filaments;
   b) optionally passing the extruded filaments through an inert gas;
   c) treating the filaments with an aqueous liquid to quench and coagulate the filaments;
   d) washing and drawing the filaments; and
   e) collecting the filaments; the improvement comprising, quench coagulating the filaments more uniformly and more rapidly in step c) by passing the filaments between substantially parallel opposing walls of a chamber containing the aqueous liquid coagulant, the said opposing walls comprising the faces of ultrasonic transducers, and driving the transducers, in phase, at a frequency of from 5 to 100 kHz to cause pressure fluctuations in the liquid coagulant, the spacing between the said opposing walls being less than one-half the wavelength of sound generated by the transducers in the liquid coagulant.

2. A process according to claim 1 wherein the polymer is an aromatic polyamide.

3. A process according to claim 2 wherein the polymer is an aramid.

4. A process according to claim 1 wherein the polymer solution that is extruded comprises m-phenylene isophthalamide, dimethylacetamide and calcium chloride.

5. A process according to claim 4 wherein the extruded filaments pass through a flow of hot nitrogen to drive off part of the solvent before quench coagulation.

6. A process according to claim 1 wherein the transducer faces are driven at a frequency in the range of 20 to 70 kHz.

* * * * *